US010021931B2

(12) United States Patent
Tulley

(10) Patent No.: US 10,021,931 B2
(45) Date of Patent: Jul. 17, 2018

(54) HELMET-CHIN MOUNT FOR ACCESSORIES, INCLUDING CAMERAS

(71) Applicant: Eric Brock Tulley, Bonney Lake, WA (US)

(72) Inventor: Eric Brock Tulley, Bonney Lake, WA (US)

(73) Assignee: SOPRO MOUNTS INC., Blaine, WA (US)

( * ) Notice: Subject to any disclaimer, the term of this patent is extended or adjusted under 35 U.S.C. 154(b) by 0 days.

(21) Appl. No.: 14/669,874

(22) Filed: Mar. 26, 2015

(65) Prior Publication Data

US 2015/0282548 A1 Oct. 8, 2015

Related U.S. Application Data

(60) Provisional application No. 61/974,271, filed on Apr. 2, 2014.

(51) Int. Cl.
*A42B 3/04* (2006.01)
*A42B 3/30* (2006.01)

(52) U.S. Cl.
CPC ..... *A42B 3/042* (2013.01); *A42B 3/04* (2013.01); *A42B 3/306* (2013.01)

(58) Field of Classification Search
CPC ..... A42B 3/0406; A42B 3/042; A42B 3/04; A16M 13/00
See application file for complete search history.

(56) References Cited

U.S. PATENT DOCUMENTS 4,270,679 A * 6/1981 Gildea ..... A42B 3/04 2/422
4,670,912 A * 6/1987 Hart ..... A42B 3/04 2/422
4,697,783 A * 10/1987 Kastendieck ..... A42B 3/042 2/10
D301,395 S 6/1989 Meldrum
4,953,766 A * 9/1990 Cruickshank ..... A42B 1/24 2/422

(Continued)

FOREIGN PATENT DOCUMENTS

KR 10-2010-0050748 A 5/2010

OTHER PUBLICATIONS

International Preliminary Report on Patentability dated Oct. 4, 2016, issued in corresponding International Application No. PCT/US2015/023190, filed Mar. 27, 2015, 8 pages.

(Continued)

*Primary Examiner* — Richale Quinn
(74) *Attorney, Agent, or Firm* — Christensen O'Connor Johnson Kindness PLLC

(57) ABSTRACT

The conventional surveillance angle, in which activities are observed from a helmet camera mounted at the top, separates a participant of an activity, such as sports, from his immediate experience. A different point of view can be taken from the camera when it is mounted via the Y-shaped accessory mount over the apogee of the helmet chin bar. This point of view is a sousveillance in which the observation is down at a human level so as to allow a consumer of the recorded contents of the sousveillance to connect with the sportsman by vicariously undergoing the immediacy of his sporting experience.

16 Claims, 7 Drawing Sheets

(56) References Cited

U.S. PATENT DOCUMENTS

| | | | | |
|---|---|---|---|---|
| 5,014,892 | A * | 5/1991 | Copeland | A45F 5/02 224/242 |
| 5,806,734 | A | 9/1998 | Scott | |
| 6,028,627 | A * | 2/2000 | Helmsderfer | A42B 3/042 345/8 |
| 6,416,239 | B1 * | 7/2002 | Chou | G06F 1/1605 248/187.1 |
| 7,234,173 | B2 | 6/2007 | McCalla | |
| 7,570,301 | B2 * | 8/2009 | Gilor | A42B 3/04 348/373 |
| 7,576,800 | B2 | 8/2009 | Swain | |
| 7,621,681 | B2 | 11/2009 | DeSorbo | |
| 8,079,501 | B2 | 12/2011 | Woodman | |
| 8,199,251 | B2 | 6/2012 | Woodman | |
| 8,342,758 | B2 | 1/2013 | Braithwaite | |
| D684,569 | S | 6/2013 | Willenborg | |
| 8,531,592 | B2 | 9/2013 | Teetzel | |
| D700,746 | S | 3/2014 | Capozzi | |
| 2008/0237422 | A1 * | 10/2008 | Dalton | A42B 3/04 248/229.1 |
| 2009/0059063 | A1 * | 3/2009 | Gallagher | A42B 3/042 348/373 |
| 2011/0239354 | A1 | 10/2011 | Celona | |
| 2014/0033406 | A1 * | 2/2014 | Lebel | A42B 3/04 2/422 |
| 2015/0026872 | A1 * | 1/2015 | Giroux Bernier | A42B 1/24 2/422 |
| 2015/0223540 | A1 * | 8/2015 | Daniels | A42B 3/042 224/272 |
| 2015/0282548 | A1 * | 10/2015 | Tulley | A42B 3/042 2/422 |
| 2015/0286117 | A1 * | 10/2015 | Sung | A42B 3/04 224/191 |
| 2015/0338659 | A1 * | 11/2015 | Gallery | A42B 3/042 345/8 |
| 2016/0212869 | A1 * | 7/2016 | Gutschenritter | H05K 5/0221 |

OTHER PUBLICATIONS

International Search Report and Written Opinion dated Jun. 26, 2015, issued in corresponding International Application No. PCT/US2015/023190, filed Mar. 27, 2015, 12 pages.

* cited by examiner

HELMET-CHIN MOUNT FOR ACCESSORIES, INCLUDING CAMERAS

CROSS-REFERENCE TO RELATED APPLICATION

This application claims the benefit of U.S. Provisional Application No. 61/974,271, filed Apr. 2, 2014, which is incorporated herein by reference

BACKGROUND

A helmet camera is a camera attached to a helmet allowing someone to make a visual record from their point of view, while keeping their hands and vision free. The first documented helmet camera was mounted to the side of a helmet at the Nissan USGP 500 World Championship at Carlsbad Raceway in Carlsbad, Calif., on Jun. 28, 1986. This system offered the viewers an unprecedented perspective of the race as it unfolded. In 1991, the World League of American Football introduced the incorporation of a miniature camera mounted on the right side of the VSR-3 Riddell helmet worn by quarterbacks. However, its use was discontinued after players complained of the extra weight.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

One aspect of the subject matter includes a system form reciting a system useful for improving cinematography technology. The system comprises a helmet having a helmet chin bar with an apogee, a Y-shaped accessory mount being fastened to the helmet chin bar by a first removable fastener to cover the apogee, and a camera being fastened to the Y-shaped accessory mount by a second removable fastener.

Another aspect of the subject matter includes a device form reciting a Y-shaped accessory mount which comprises a body on which a female member of a quick-release buckle is fastened; first and second wings, which are flexible, connected to the body; and a tail having first and second rudders, which are flexible, connected to the body.

A further aspect includes another system form reciting a system which comprises a helmet having a chin bar with a first and second portion connected to an apogee; a Y-shaped accessory mount having a body on which a female member of a quick-release buckle is fastened, first and second wings, which are flexible, connected to the body, a tail having first and second rudders, which are flexible, connected to the body, and a strap which is capable of strapping the Y-shaped accessory mount to the first and second portions of the chin bar to cover the apogee; and an accessory hingedly coupled to a male member of the quick-release buckle.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
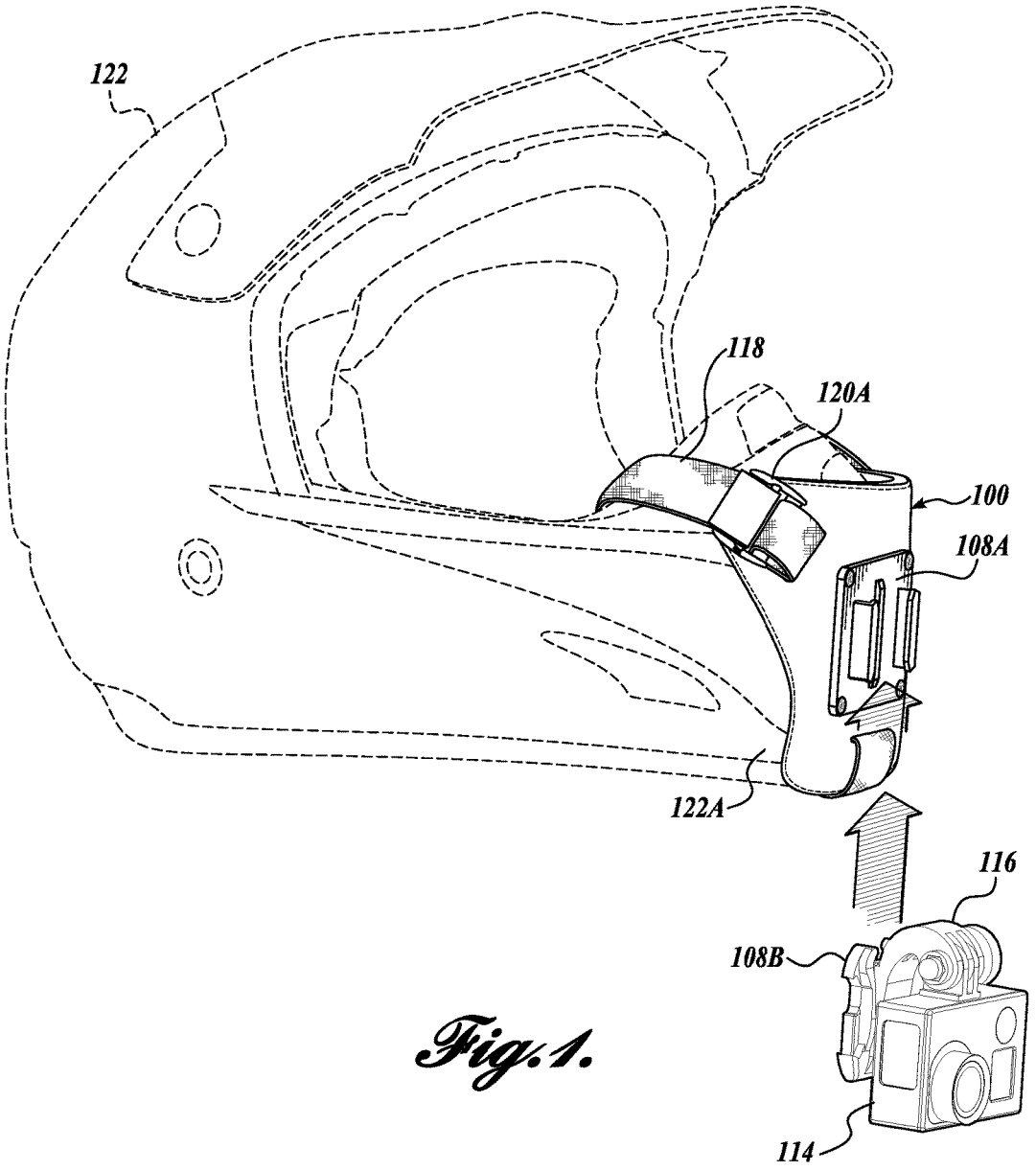
FIG. 1 is an isometric perspective view from a side of an archetypical Y-shaped accessory mount installed on a helmet workpiece with a strap coupled to a camera workpiece.

FIG. 1 illustrates a helmet 122 having a helmet chin bar 122*a*. The helmet 122 includes, in one embodiment, a full face helmet covering the entire head, with a rear that covers the base of the skull, and a protective section (the helmet chin bar 122*a*) over the front of the chin. Such helmets have an open cutout in a band across the eyes and nose, and often include a clear or tinted transparent plastic face shield, known as a "visor", that generally swivels up and down to allow access to the face. In another embodiment, the helmet 122 includes an off-road or motocross helmet showing the elongated sun visor and the helmet chin bar 122*a*. The off-road or motocross helmet has clearly elongated chin and visor portions, a chin bar (the helmet chin bar 122*a*), and a partially open face to give the rider extra protection while wearing goggles and to allow the unhindered flow of air during the physical exertion of this type of riding. The helmet 122 includes, in a further embodiment, a modular or "flip-up" or "convertible" or "flip-face" helmet, which is a hybrid between full face and open face helmets for street use. When fully assembled and closed, they resemble full face helmets by bearing the helmet chin bar 122*a* for absorbing face impacts. The chin bar 122*a* may be pivoted upwards (or, in some cases, may be removed) by a special lever to allow access to most of the face, as in an open face helmet. This is desirable for users who use eyeglasses as it allows them to fit into a helmet without removing their glasses.

Figure 8:
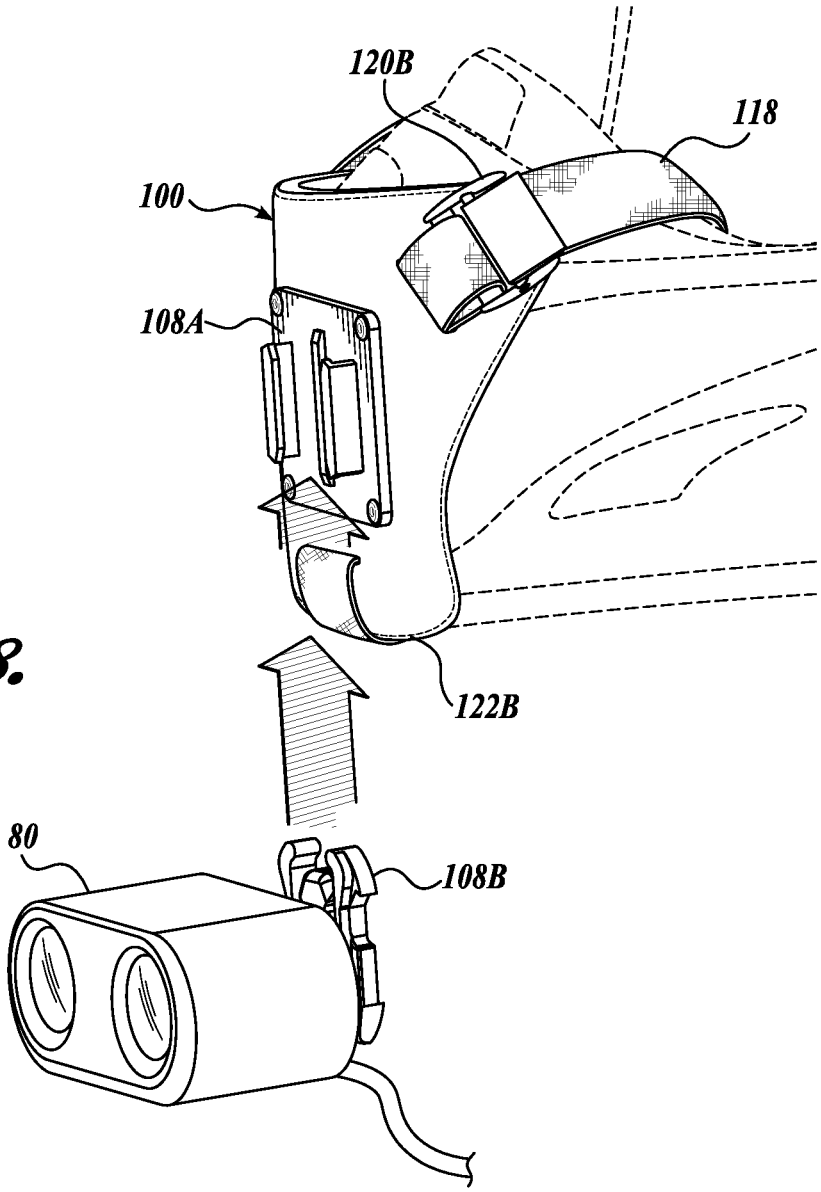
FIG. 8 is an isometric perspective view from a side of an archetypical Y-shaped accessory mount installed on a helmet workpiece with a strap coupled to a flashlight workpiece.
Figure 9:
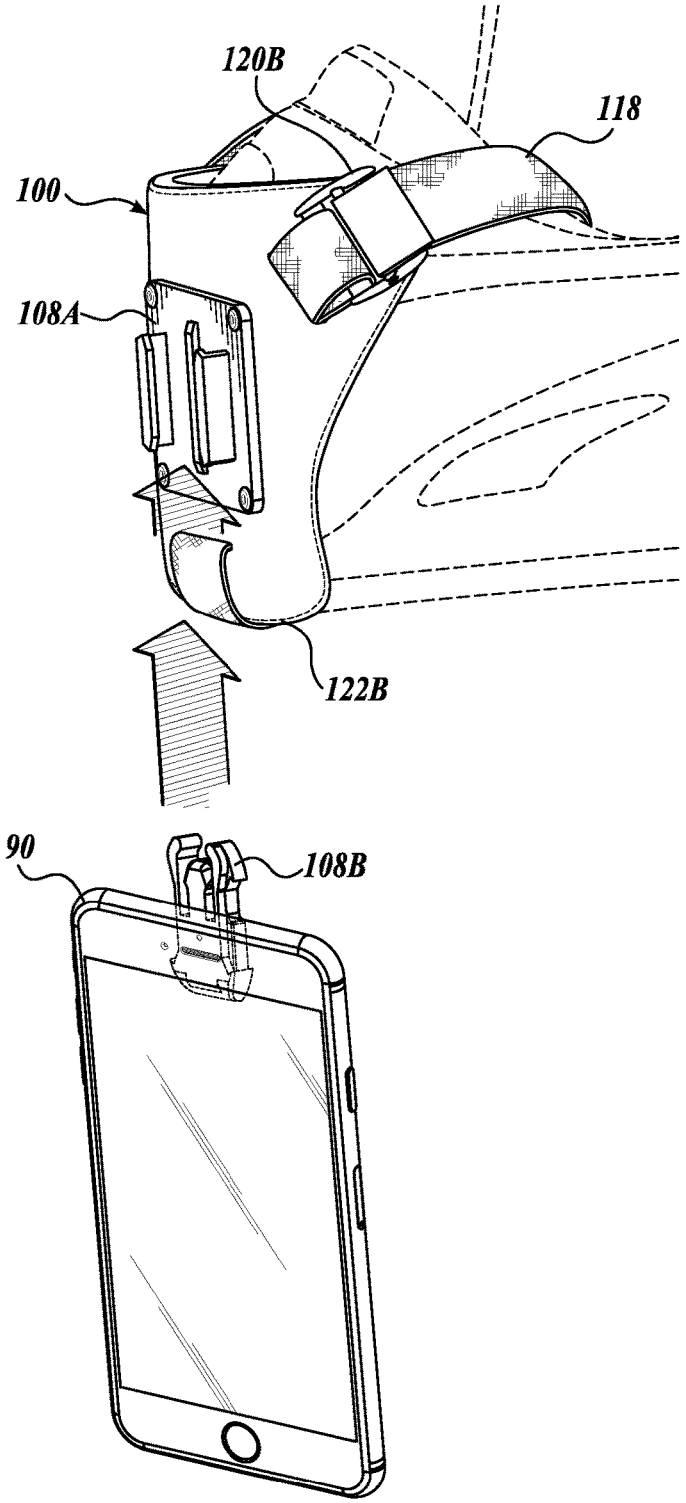
FIG. 9 is an isometric perspective view from a side of an archetypical Y-shaped accessory mount installed on a helmet workpiece with a strap coupled to a smartphone.

FIGS. 1-5 illustrate a Y-shaped accessory mount 100 which is engineered to attach to the helmet chin bar 122*a* as a support using a strap 118, the fastening of which is secured by tension lock buckles 120*a*, 120*b*. A female member 108*a* of a quick-release buckle 108 is set near the center of the Y-shaped accessory mount 100 and is fastened to 30 it by four bolts 110*a*-110*d*. A male member 108*b* of the quick-release buckle 108 is mechanically coupled to an accessory, such as a camera 114, by a J-hook joint 116. To mount an assembly containing the camera to the helmet 122, the male member 108*b* engages the female member 108*a*, the sliding of which mates the assembly containing the camera 114 to the helmet 122's Y-shaped accessory mount 100. Any suitable accessory can be used instead of the camera 114, such as a flashlight 80. See FIG. 8. Other suitable accessories include a smart phone 90. See FIG. 9.

Figure 2:
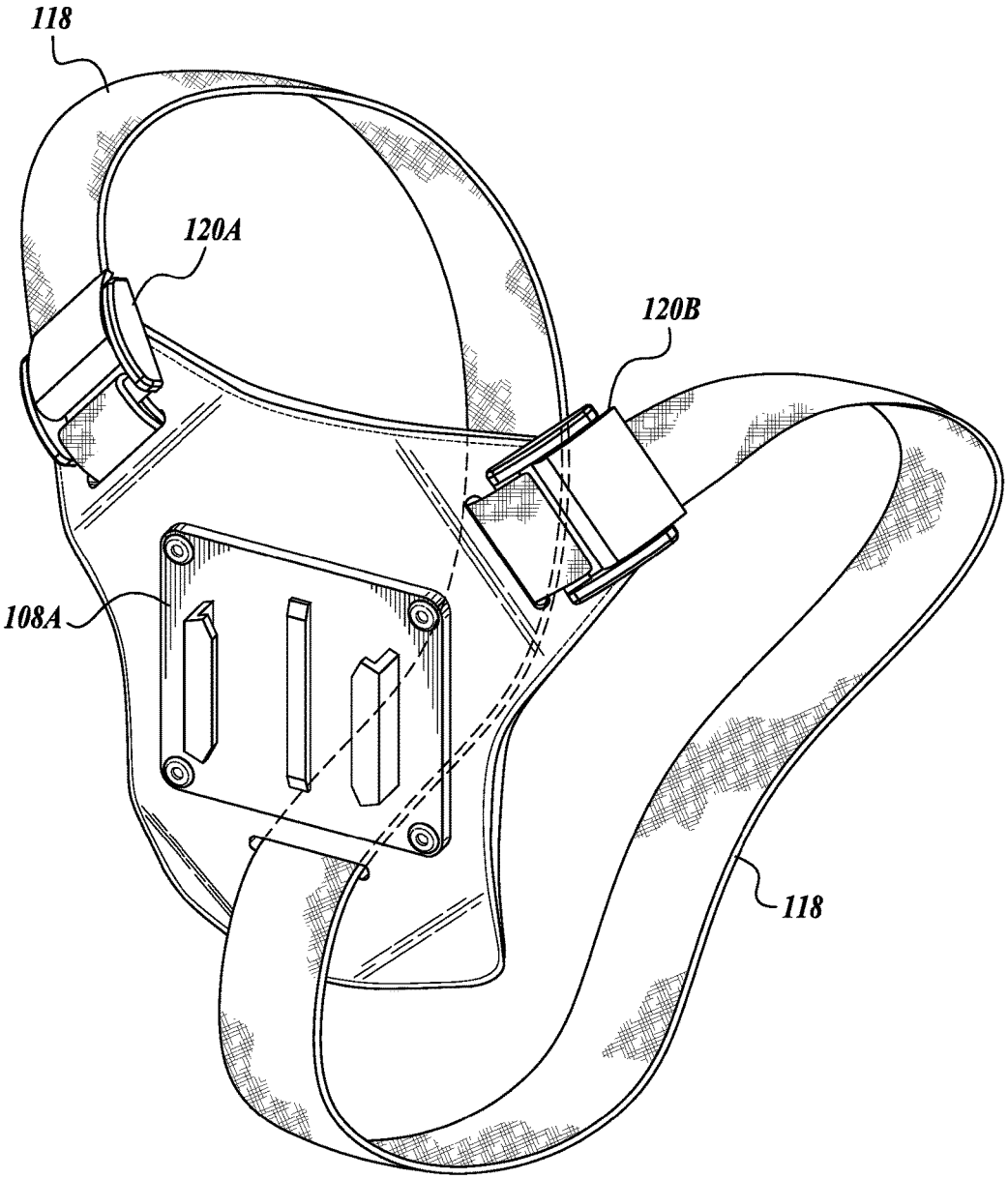
FIG. 2 is another isometric perspective view from the front of an archetypical Y-shaped accessory mount with its strap.

FIG. 2 illustrates a chape of each tension lock buckles 120*a*, 120*b* being secured in proximity to a respective wing 102*a*, 102*b* of the Y-shaped accessory mount 100. Each chape is catched to a loop of fabric which in turn is fastened to the Y-shaped accessory mount through a respective slit 106*a*, 106*b*. The strap 118, after being held by the tension lock buckle 120*a*, winds a first portion of the helmet chin bar 122*a* to partially secure the Y-shaped accessory mount 100 over the apogee of the helmet chin bar 122*a* (removed for illustration purposes), enters through a slit 106*c* from the back of the Y-shaped accessory mount 100 out the front of the Y-shaped accessory mount 100, loops through a second portion of the helmet chin bar 122*b* (removed for illustration purposes), and winds to the tension lock buckle 120*b* so as to completely secure the Y-shaped accessory mount 100 to the helmet chin bar 122*a*. The tension lock buckles 120*a*, 120*b* have hinged doors that can be opened to release the tension in which any excess of the strap 118 can be moved to further secure the Y-shaped accessory mount 100 to the helmet chin bar 122*a*, and after which, the hinged doors can be closed to apply tension to secure the strap 118.

Figure 4:
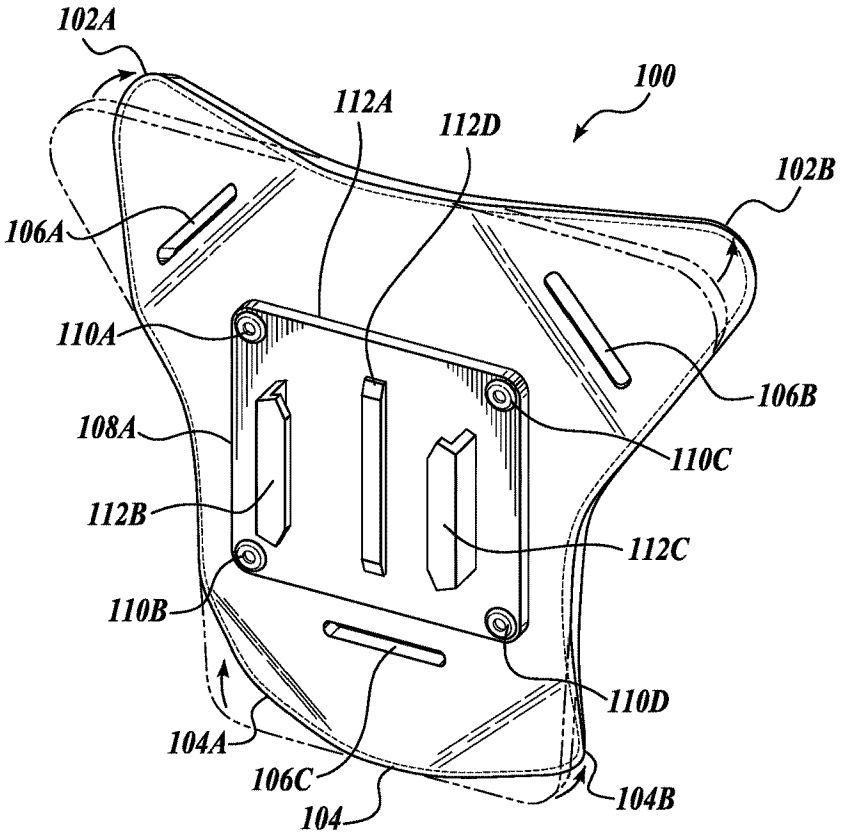
FIG. 4 is a further isometric perspective view from the front of an archetypical Y-shaped accessory mount without its strap showing the flexibility of its engineered portions.
Figure 3:
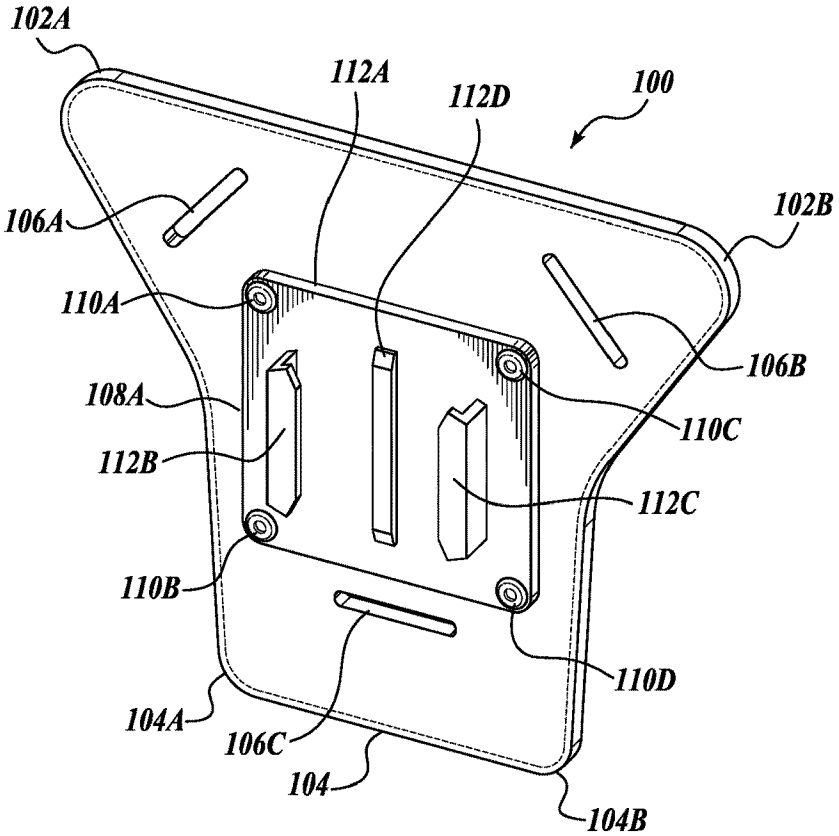
FIG. 3 is an additional isometric perspective view from the front of an archetypical Y-shaped accessory mount without its strap.

FIGS. 3 and 4 illustrate the Y-shaped accessory mount 100 with the tension lock buckles 120*a*, 120*b*; their loops of fabric fasteners; and the strap 118 illustratively removed for specific discussion of the Y-shaped accessory mount 100. The Y-shaped accessory mount 100 is engineered with the two wings 102*a*, 102*b* and a tail 104 having two rudders 104*a*, 104*b*, each being located at a corner of the tail 104. Both the wings 102*a*, 102*b* and the rudders 104*a*, 104*b* are engineered to be flexible so that they can be shaped to fit the Y-shaped accessory mount 100 over the apogee of the helmet chin bar 122*a*.

The Y-shaped accessory mount 100 is useful to improve ease of access to accessories mounted on it compared to side mounts or top mounts. Given that the location of the chin is anatomically closer to the reach of the arms and it is well centered to the body, this placement facilitates better access during the dynamics of the angles of the body of the sportsman during play. In addition, a chin mount is less susceptible to dislodging by obstacles during use. The Y-shaped accessory mount 100 is engineered to universally work with many helmet styles as the flexible wings 102*a*, 102*b* and the flexible rudders 104*a*, 104*b* of the Y-shaped accessory mount 100 permit molding to many shapes of the apogee of the helmet chin bar 122*b*. The Y-shaped accessory mount 100 is also removable via the strap 118 in combination with the tension lock buckles 120*a*, 120*b* so as to be used on another helmet in the field without any adhesives. The Y-shaped accessory mount 100 is suitably manufactured from aircraft grade aluminum with a thickness ranging from 0.01 to 0.035 inch. Suitably, the Y-shaped accessory mount 100 is covered with a foam whose thickness ranges from 1/16 of an inch to 1/8 of an inch. The width of the strap 118 is suitably about 3/4 of an inch.

Figure 5C:
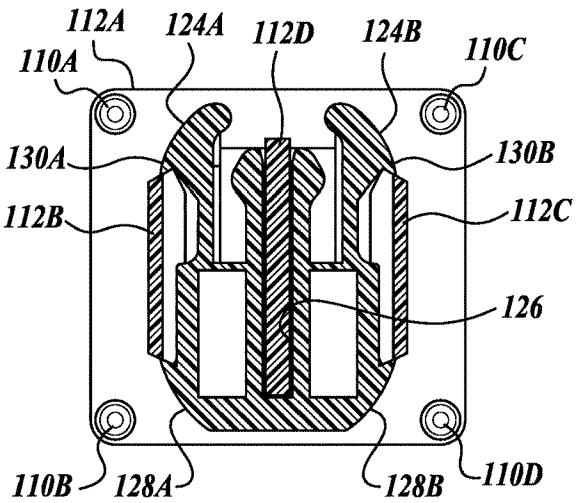
FIGS. 5*a*-5*c* are top plan views of members of an archetypical quick-release buckle.
Figure 5B:
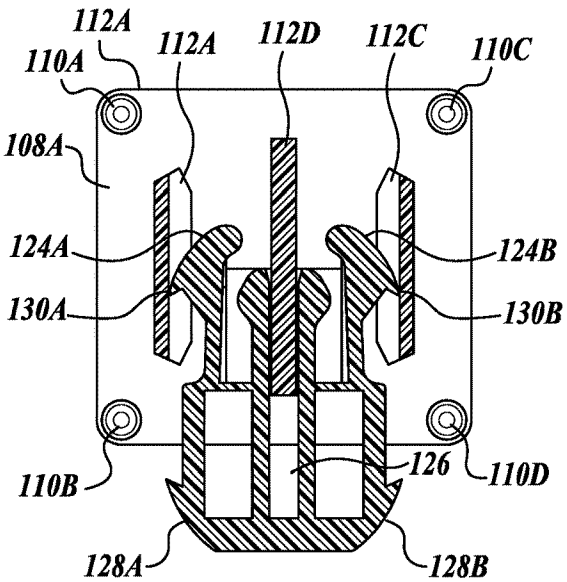
Figure 5A:
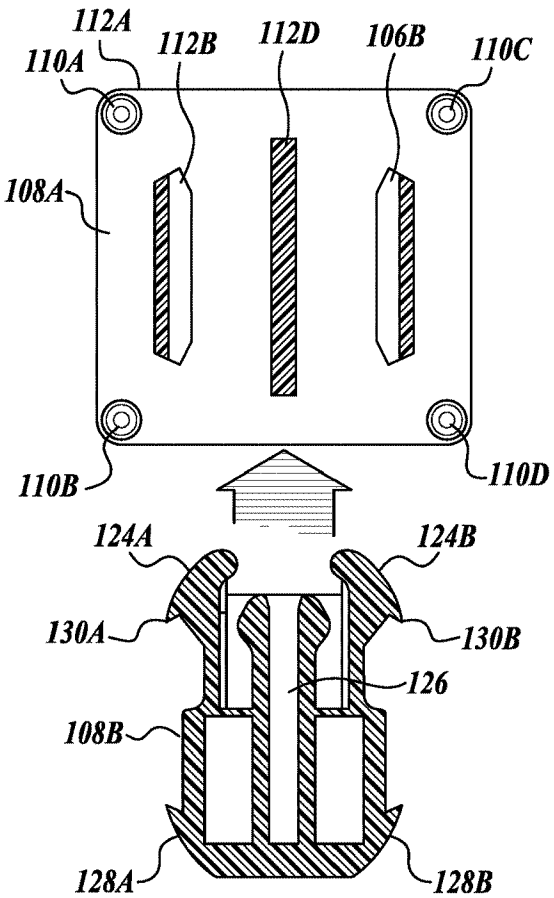

FIGS. 5*a*-5*c* illustrate the operations of the quick-release buckle 108. The female member 108*a* of the quick-release buckle 108 appears as a rectangular frame which is secured to the Y-shaped accessory mount 100 by the bolts 110*a*-110*d* located at each corner of the female member 108*a*. At the center of the female member 108*a* is a female guide bar 112*d* appearing longitudinally whose termini are notched. Spaced apart from the female guide bar 112*d* are L-shaped female prongs 112*b*, 112*c*.

The quick-release buckle 108 includes the male member 108*b*. At a distal end of the male member 108*b* are stopping flanges 128*a*, 128*b*. A guiding slot 126 is engineered to define a longitudinal void traversing a substantial portion of the length of the body of the male member 108*b*. The termini of the male member 108*b* end in male prongs 124*a*, 124*b*, each of which has a spine 120*a*, 120*b*.

In operation, the male prongs 124*a*, 124*b* of the male member 108*b* engage the proximal ends of the L-shaped female prongs 112*b*, 112*c* into which the male prongs 124*a*, 124*b* slide while the guiding slot 126 of the male member 108*b* hosts the female guide bar 112*d*. Final pressure is made once the male prongs 124*a*, 124*b* of the male member 108*b* reach the distal ends of the L-shaped female prongs 112*b*, 112*c* so as to cause the spines 130*a*, 130*b* of the male member 108*b* to hook into the distal ends of the L-shaped female prongs 112*b*, 112*c*. Stopping flanges 128*a*, 128*b* of the male member 108*b* terminate further movement of the male member 108*b* beyond the distal ends of the L-shaped female prongs 112*b*, 112*c*.

Figure 7:
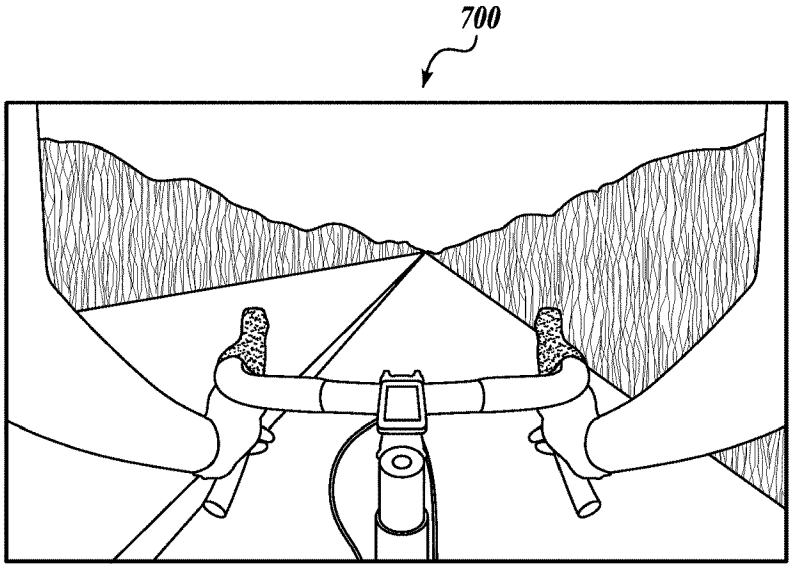
FIG. 7 is a pictorial diagram showing a view of a camera workpiece when the camera workpiece is mounted on a chin of a helmet workpiece.
Figure 6:
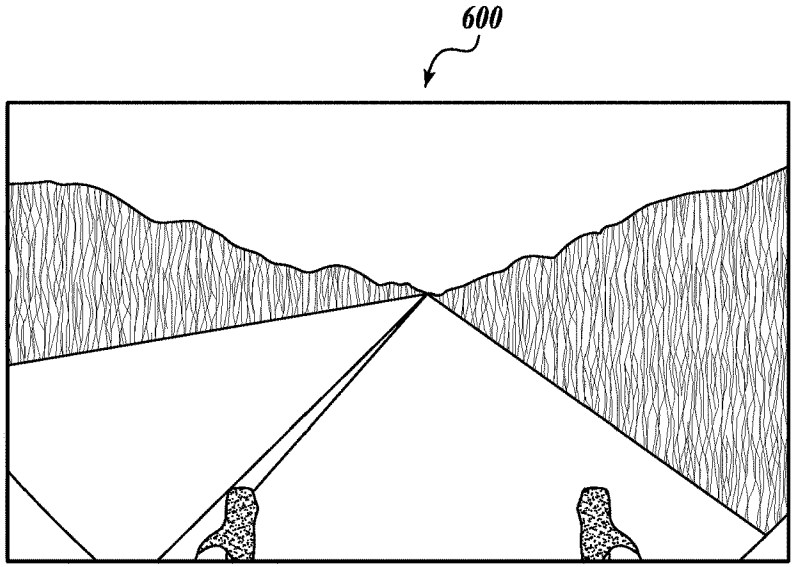
FIG. 6 is a pictorial diagram showing a view of a camera workpiece when the camera workpiece is mounted on top of a helmet workpiece.

FIG. 6 illustrates a point of view 600 taken from the camera 114 when it is mounted via the Y-shaped accessory mount 100 on the top of the helmet 122. The point of view 600 is a conventional surveillance angle in which activities are observed from above, separating a participant of an activity, such as a sports event, from his immediate experience. FIG. 7 illustrates another point of view 700 taken from the camera 114 when it is mounted via the Y-shaped accessory mount 100 over the apogee of the helmet chin bar 122*a*. The point of view 700 is a sousveillance in which the observation is down at a human level so as to allow a consumer of the recorded contents of the sousveillance to connect with the sportsman by vicariously undergoing the immediacy of his sporting experience. The point of view 700 is useful for improving the cinematography experience.

While illustrative embodiments have been illustrated and described, it will be appreciated that various changes can be made therein without departing from the spirit and scope of the invention.

The embodiments of the invention in which an exclusive property or privilege is claimed are defined as follows:

1. A system useful for improving cinematography technology, comprising:

a helmet having a helmet chin bar with a first and second portion connected to an apogee;

a Y-shaped accessory mount being fastened to the helmet chin bar; and a camera or a flashlight being fastened to the Y-shaped accessory mount by a removable fastener;

wherein the Y-shape accessory mount has a body on which a female member of the second removable fastener is fastened; first and second wings, which are flexible, connected to the body; a tail having first and second rudders, which are flexible, connected to the body; and a strap which fastens the Y-shaped accessory mount to the first and second portions of the chin bar to cover the apogee;

wherein the body of the Y-shaped accessory mount includes a first slit located on the first wing, a second slit located on the second wing, and a third slit located on the tail, the first slit facilitating a first loop of fabric fastened to the body to protrude through the first slit to catch a first chape of a first tension lock buckle, the second slit facilitating a second loop of fabric fastened to the body to protrude through the second slit to catch a second chape of a second tension lock buckle;

wherein a first terminus of the strap is held by the first tension lock buckle;

wherein a second terminus of the strap is held by the second tension lock buckle;

wherein a portion of the strap between the first terminus and the second terminus passes through the third slit;

wherein the strap wraps around the first portion of the chin bar between the first terminus and the third slit; and wherein the strap wraps around the second portion of the chin bar between the third slit and the second terminus.

2. The system of claim 1, wherein the helmet is a full face helmet.

3. The system of claim 1, wherein the helmet is an off-road helmet or a motocross helmet.

4. The system of claim 1, wherein the helmet is a modular helmet or a flip-up helmet or a convertible helmet or a flip-face helmet.

5. The system of claim 1, wherein the removable fastener is a quick-release buckle.

6. The system of claim 1, wherein the camera is a camera in a phone.

7. A Y-shaped accessory mount for a helmet having a chin bar, wherein the chin bar includes an apogee, a first portion, and a second portion, the Y-shaped accessory mount comprising:

a body on which a female member of a quick-release buckle is fastened;

first and second wings, which are flexible, connected to the body; and a tail having first and second rudders, which are flexible, connected to the body;

wherein the body includes a first slit located on the first wing, a second slit located on the second wing, and a third slit located on the tail, the first slit facilitating a first loop of fabric fastened to the body to protrude through the first slit to catch a first chape of a first tension lock buckle, the second slit facilitating a second loop of fabric fastened to the body to protrude through the second slit to catch a second chape of a second tension lock buckle;

wherein a first terminus of the strap is held by the first tension lock buckle;

wherein a second terminus of the strap is held by the second tension lock buckle;

wherein a portion of the strap between the first terminus and the second terminus passes through the third slit;

wherein the strap between the first terminus and the third slit wraps around the first portion of the chin bar of the helmet; and wherein the strap between the third slit and the second terminus wraps around the second portion of the chin bar of the helmet.

8. The Y-shaped accessory mount of claim 7, wherein the strap has a width of about ¾ of an inch.

9. The Y-shaped accessory mount of claim 7, wherein the Y-shaped accessory mount is manufactured from aluminum.

10. The Y-shaped accessory mount of claim 7, wherein the Y-shaped accessory mount has a thickness of about 0.01 to 0.035 inch.

11. The Y-shaped accessory mount of claim 7, wherein the Y-shaped accessory mount is covered with a foam.

12. The Y-shaped accessory mount of claim 10, wherein the foam has a thickness of about 1/16 of an inch to ⅛ of an inch.

13. A system comprising:

a helmet having a chin bar with a first and second portion connected to an apogee;

a Y-shaped accessory mount having a body on which a female member of a quick-release buckle is fastened; first and second wings, which are flexible, connected to the body; a tail having first and second rudders, which are flexible, connected to the body; and a strap which is capable of strapping the Y-shaped accessory mount to the first and second portions of the chin bar to cover the apogee; and an accessory hingedly coupled to a male member of the quick-release buckle;

wherein the body of the Y-shaped accessory mount includes a first slit located on the first wing, a second slit located on the second wing, and a third slit located on the tail, the first slit facilitating a first loop of fabric fastened to the body to protrude through the first slit to catch a first chape of a first tension lock buckle, the second slit facilitating a second loop of fabric fastened to the body to protrude through the second slit to catch a second chape of a second tension lock buckle;

wherein a first terminus of the strap is held by the first tension lock buckle;

wherein a second terminus of the strap is held by the second tension lock buckle;

wherein a portion of the strap between the first terminus and the second terminus passes through the third slit;

wherein the strap wraps around the first portion of the chin bar between the first terminus and the third slit; and wherein the strap wraps around the second portion of the chin bar between the third slit and the second terminus.

14. The system of claim 13, wherein the accessory is a camera, a video recorder, a video camera, a phone, or a flashlight.

15. The Y-shaped accessory mount of claim 13, wherein the Y-shaped accessory mount is manufactured from aluminum.

16. The Y-shaped accessory mount of claim 13, wherein the Y-shaped accessory mount is covered with a piece of foam.

* * * * *